US008282093B2

(12) United States Patent
Sugishima

(10) Patent No.: US 8,282,093 B2
(45) Date of Patent: Oct. 9, 2012

(54) SHEET FEEDER AND IMAGE FORMING APPARATUS PROVIDED WITH THE SAME

(75) Inventor: Yoshio Sugishima, Osaka (JP)

(73) Assignee: Kyocera Mita Corporation (JP)

( * ) Notice: Subject to any disclaimer, the term of this patent is extended or adjusted under 35 U.S.C. 154(b) by 19 days.

(21) Appl. No.: 13/049,927

(22) Filed: Mar. 17, 2011

(65) Prior Publication Data

US 2011/0233851 A1 Sep. 29, 2011

(30) Foreign Application Priority Data

Mar. 26, 2010 (JP) ..... 2010-072152

(51) Int. Cl.
*B65H 1/18* (2006.01)

(52) U.S. Cl. ..... 271/152; 271/164

(58) Field of Classification Search ..... 271/152–155, 271/164

See application file for complete search history.

(56) References Cited

U.S. PATENT DOCUMENTS 5,897,112 A * 4/1999 Kwag ..... 271/38
6,145,832 A * 11/2000 Saito et al. ..... 271/162

FOREIGN PATENT DOCUMENTS

JP 2000-118792 4/2000
JP 2000-267372 9/2000
JP 200180759 3/2001

* cited by examiner

*Primary Examiner* — Michael McCullough

(74) *Attorney, Agent, or Firm* — Gerald E. Hespos; Michael J. Porco

(57) ABSTRACT

A sheet feeder includes a sheet cassette insertable into a housing in a first direction, a remaining amount detecting member including a contact piece extending in a second direction opposite to the first direction and coming into contact with an uppermost sheet, and detecting a remaining amount of sheets according to a position of the contact piece, and a switching member switching the position of the contact piece between a contact position where the contact piece enters a storage space to come into contact with the uppermost sheet and a retracted position where the contact piece is retracted from the storage space. The position is switched to the contact position when the sheet cassette is inserted into the housing in the first direction and set to a feeding position while switched to the retracted position when the sheet cassette is separated from the feeding position and withdrawn from the housing.

8 Claims, 10 Drawing Sheets

1
2
3
21
22
23
24
25
31
32
33
34
35
36
37
38
211
231
251
252
253
A

SHEET FEEDER AND IMAGE FORMING APPARATUS PROVIDED WITH THE SAME

BACKGROUND OF THE INVENTION

1. Field of the Invention

The present invention relates to a sheet feeder for feeding a sheet in a predetermined direction and an image forming apparatus provided with such a sheet feeder.

2. Description of the Related Art

An image forming apparatus such as a copier, a printer or a facsimile machine includes an image forming unit for forming an image on a sheet and a sheet feeder for feeding a sheet to the image forming unit.

For example, according to a first technology, a sheet feeder includes, as main constituent elements, a sheet cassette for storing sheets, a feed roller for feeding a sheet in the sheet cassette to an image forming unit, and a retard roller arranged to face the feed roller while being held in contact therewith to prevent simultaneous feed of plural sheets. In the sheet feeder of the first technology, an inserting direction of the sheet cassette into a housing of the image forming apparatus is the same as a feeding direction of a sheet to the image forming unit by the feed roller.

Since a remaining amount of sheets in the sheet cassette decreases as sheets are fed to the image forming unit, it needs to be notified to a user. A member for detecting the remaining amount of sheets is known according to a second technology.

A remaining amount detecting member of the second technology includes a sensor piece held in contact with the uppermost one of sheets in a sheet cassette, a photosensor which is a photointerrupter, and a light shielding piece for shielding light from the photosensor. Since the light shielding piece is constructed to rotate according to a height position of the sensor piece in a vertical direction, its rotation amount changes according to the remaining amount of sheets in the sheet cassette. An amount of the light to be shielded is determined according to the rotation amount of the light shielding piece, and the remaining amount of sheets in the sheet cassette is judged according to the amount of the shielded light.

If the remaining amount detecting member as disclosed in the second technology is applied to the sheet feeder of the first technology, it may be damaged. Specifically, if the sensor piece of the remaining amount detecting member of the second technology is formed to come into contact with the uppermost one of the sheets in the sheet cassette in a direction opposite from the inserting direction of the sheet cassette into the housing of the image forming apparatus, i.e. if the inserting direction of the sheet cassette into the housing and a contacting direction of the sensor piece with the uppermost sheet are opposite to each other, the sensor piece is easily caught by a side wall of the sheet cassette or the uppermost sheet when the sheet cassette is inserted into the housing. If being caught by the uppermost sheet, the sensor piece may be damaged. If this occurs, the remaining amount of sheets in the sheet cassette cannot be accurately detected.

SUMMARY OF THE INVENTION

In view of the above situation, an object of the present invention is to provide a sheet feeder capable of preventing a remaining amount detecting member from being damaged upon inserting a sheet cassette and an image forming apparatus provided with such a sheet feeder.

In order to accomplish this object, the present invention is directed to a sheet feeder including a housing, a sheet cassette having a storage space for storing sheets and insertable into the housing in a first direction, a feed roller feeding the sheets from the sheet cassette when the sheet cassette is set to a feeding position, a remaining amount detecting member including a rotatable contact piece and detecting a remaining amount of the sheets in the sheet cassette according to a position of the contact piece, the contact piece extending in a second direction opposite to the first direction, including a supporting point at an upstream side in the second direction and coming into contact with the uppermost one of the sheets in the sheet cassette at a downstream side, and a switching member switching the position of the contact piece between a contact position where the contact piece enters the storage space to come into contact with the uppermost sheet and a retracted position where the contact piece is retracted from the storage space. The switching member switches the position of the contact piece to the contact position when the sheet cassette is inserted into the housing in the first direction and set to the feeding position while switching the position of the contact piece to the retracted position when the sheet cassette is separated from the feeding position and withdrawn from the housing.

These and other objects, features and advantages of the present invention will become more apparent upon reading the following detailed description along with the accompanying drawings.

DESCRIPTION OF THE PREFERRED EMBODIMENTS

Hereinafter, one embodiment of the present invention is described with reference to the drawings. Direction-indicating terms such as "upper", "lower", "left" and "right" are merely used in the following description for the purpose of clarifying the description and not of the nature to limit the present invention. A term "sheet" used in the following description generally means a print sheet on which a printing process is to be performed, but the present invention is not limited to this and the term "sheet" also means a tracing paper, an OHP sheet, a thin paper sheet or another sheet on which an image can be formed.

Figures 1A, 1B, 1C:
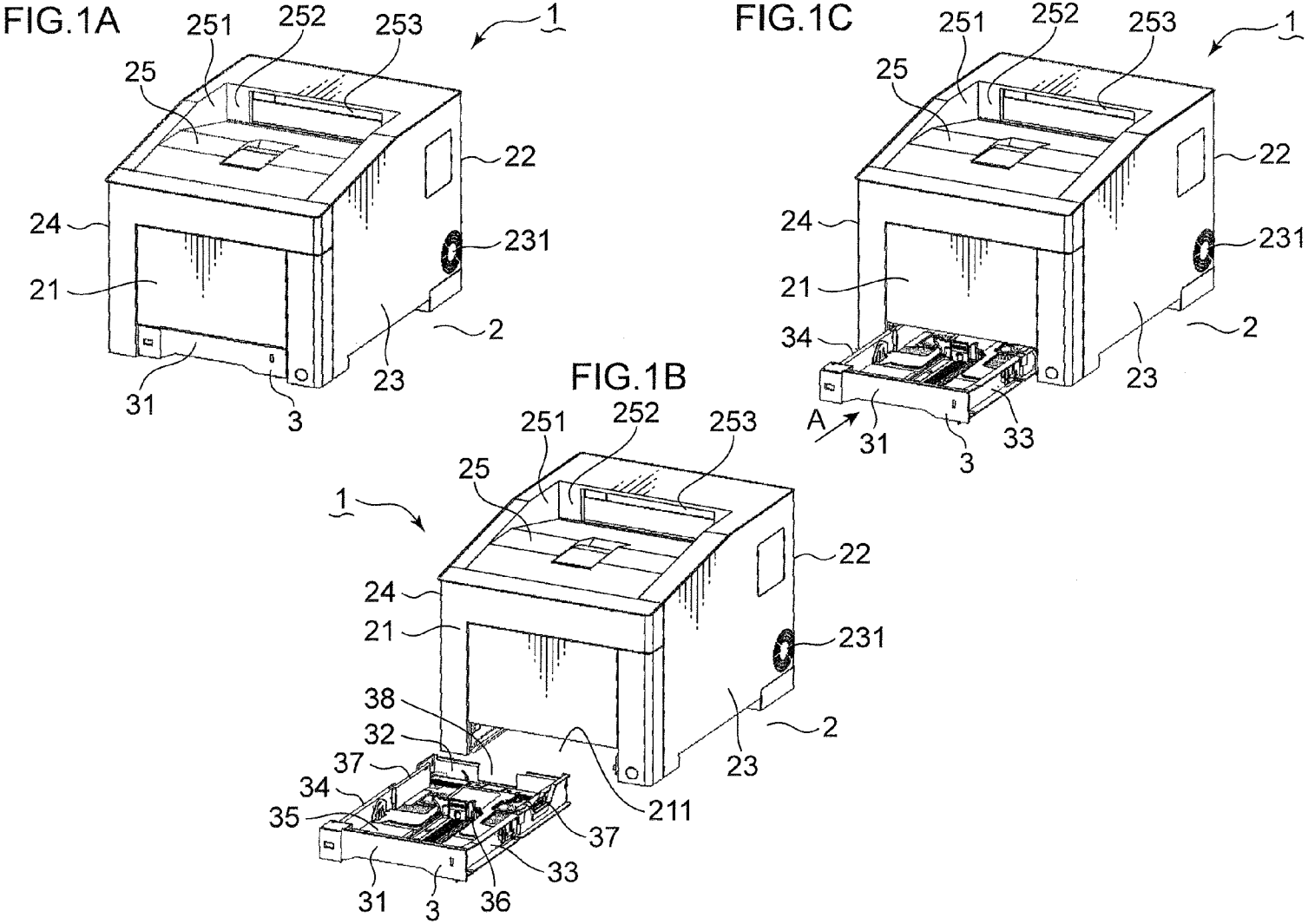
FIG. 1A is a perspective view of a printer according to one embodiment of the invention showing a state where a sheet cassette is completely housed in a housing of the printer.
FIG. 1B shows a state where the entire sheet cassette is withdrawn from the housing.
FIG. 1C shows a state where the sheet cassette is partly inserted in the housing.

FIG. 1A is an external perspective view of an image forming apparatus according to one embodiment of the present invention showing a state where a sheet cassette is completely housed in the image forming apparatus. FIG. 1B shows a state where the entire sheet cassette is withdrawn from the image forming apparatus. FIG. 1C shows a state where the sheet cassette is partly inserted in the image forming apparatus. Note that the image forming apparatus shown in FIGS. 1A to 1C is a printer, but the present invention is not limited to this and the image forming apparatus may be another apparatus capable of forming an image on a sheet such as a copier or a facsimile machine. Further, the image forming apparatus is not limited to the one that performs image formation using toner, and may perform image formation using ink jet.

A printer 1 includes a substantially rectangular parallelepipedic housing 2 as a whole. The housing 2 includes a front wall 21 formed with a substantially rectangular opening 211 as an insertion opening for a sheet cassette 3, a rear wall 22 located at a position facing the front wall 21, a right wall 23 and a left wall 24 extending between the front wall 21 and the rear wall 22 and forming side surfaces of the printer 1, and a ceiling wall 25 extending between the front wall 21 and the rear wall 22 and forming the upper surface of the printer 1.

A substantially rectangular parallelepipedic storage space extends from the opening 211 of the front wall 21 toward the rear wall 22. The outer peripheral contour of the sheet cassette 3 has a shape complementary to this storage space. The sheet cassette 3 is movable from the side of the front wall 21 toward the rear wall 22. Further, by pulling the sheet cassette 3 from the rear wall 22 toward the front wall 21, the sheet cassette 3 can be withdrawn from the housing 2. In this way, the sheet cassette 3 is formed to be reciprocally movable in the storage space.

Various devices for fulfilling the function of the printer 1 are arranged in the housing 2. A radiator vent 231 for releasing heat generated from these devices is formed in the right wall 23. A recessed space 251 tapered toward the front wall 21 is formed on the ceiling wall 25, and a base end portion of the recessed space 251 located at the side of the rear wall 22 is formed by a discharge wall 252. The discharge wall 252 is formed with a discharge opening 253 for discharging a sheet having an image formed thereon. Sheets, on which an image forming process has been performed, are discharged from the discharge opening 253 and stacked in the recessed space 251 on the ceiling wall 25.

The sheet cassette 3 includes a front wall 31 which forms the front wall surface of the printer 1 together with the front wall 21 of the housing 2 when the sheet cassette 3 is completely pushed into the housing 2, a rear wall 32 located at a position facing the front wall 31, a right wall 33 and a left wall 34 extending between the front wall 31 and the rear wall 32 and forming side surfaces of the sheet cassette 3, and a bottom wall 35 extending between the front wall 31 and the rear wall 32 and forming the bottom surface of the sheet cassette 3.

A first adjustment member 36 reciprocally movable along a straight line extending from the front wall 31 toward the rear wall 32 and a pair of second adjustment members 37 reciprocally movable along a straight line connecting the right and left walls 33, 34 stand on the upper surface of the bottom wall 35 of the sheet cassette 3. The first and second adjustment members 36, 37 are positioned in contact with side surfaces of a stack of sheets stored in the sheet cassette 3 (surfaces formed by edge portions of sheets stacked one over another), and a storage space 38 for storing the sheets is formed by the first adjustment member 36, the pair of second adjustment members 37 and the inner surface of the rear wall 32.

Figure 2:
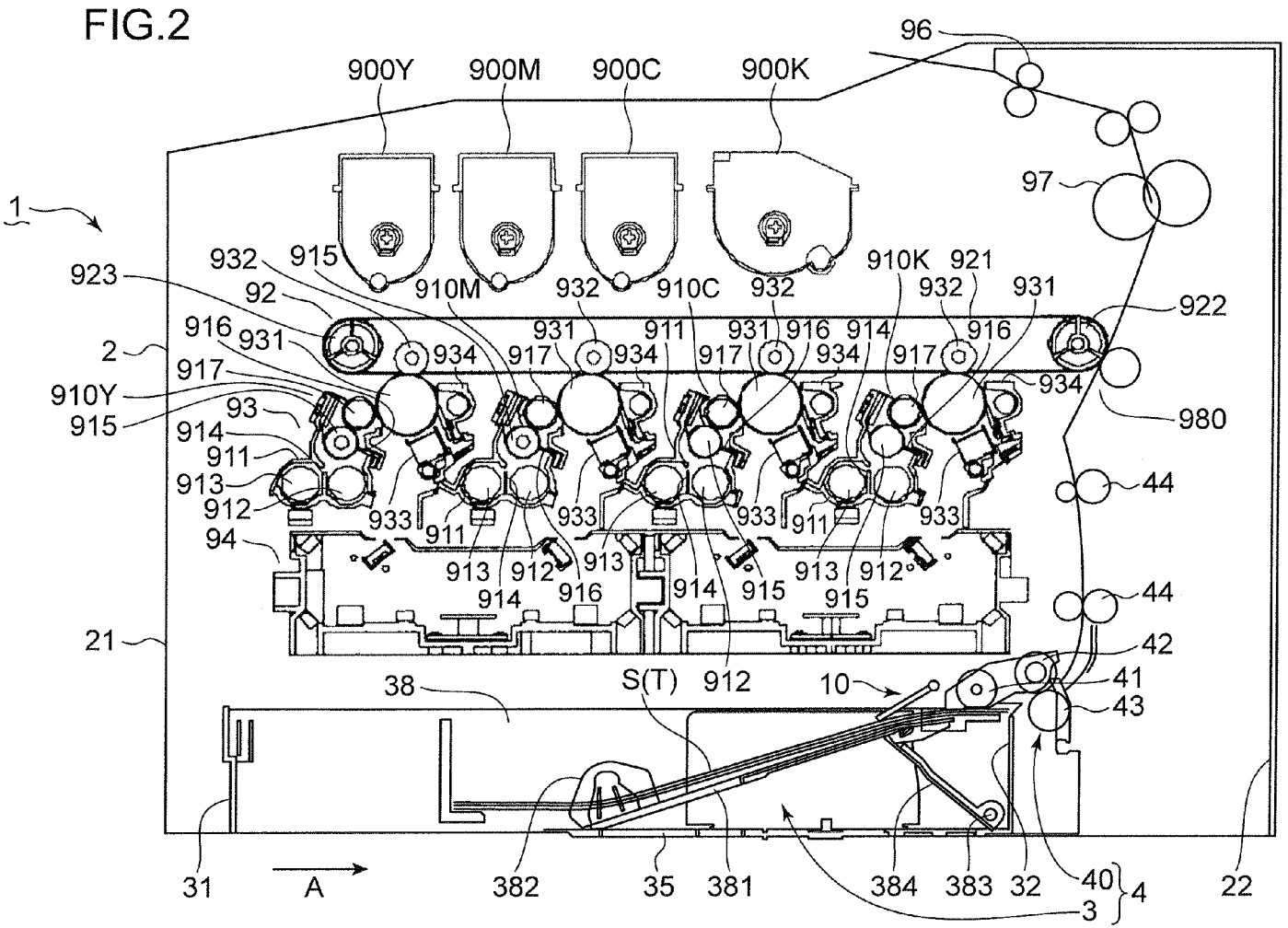
FIG. 2 is a sectional view showing an internal structure of the printer shown in FIGS. 1A to 1C.

FIG. 2 schematically shows an internal structure of the printer 1 shown in FIGS. 1A to 1C. The internal structure of the printer 1 is described with reference to FIGS. 1A to 1C together with FIG. 2. Note that the printer 1 is connected to a personal computer (PC) (not shown) directly or via a LAN. An external apparatus such as the personal computer transmits image data to the printer 1. In addition to constituent elements described below with reference to FIG. 2, the printer 1 includes other constituent elements provided in common printers such as a control circuit for controlling the operation of the printer 1.

As shown in FIG. 2, an intermediate transfer unit 92, an image forming unit 93, an exposure unit 94, a fixing unit 97, a pair of discharge rollers 96 and a sheet feeder 4 are provided in the housing 2.

The image forming unit 93 includes photosensitive drums 931 (photoconductors on which latent images are formed by an electrophotographic process) bearing toner images of respective colors of yellow, magenta, cyan and black. Photosensitive drums using an amorphous silicon (a-Si) containing material can be used as the photosensitive drums 931.

A charger 933, a developing device 910 (910Y, 910M, 910C, 910K), a transfer roller 932, a cleaner 934 and the like are arranged around each photosensitive drum 931. Each charger 933 uniformly charges a surface of the corresponding photosensitive drum 931. The surface of each photosensitive drum 931 after charging is exposed by the exposure unit 94 to form an electrostatic latent image. The developing devices 910Y, 910M, 910C and 910K develop the electrostatic latent images formed on the respective photosensitive drums 931 (into visible images) using toners of the respective colors supplied from toner containers 900Y, 900M, 900C and 900K. The transfer rollers 932 form nip portions by sandwiching an intermediate transfer belt 921 between themselves and the photosensitive drums 931 and primarily transfer toner images on the photosensitive drums 931 onto the intermediate transfer belt 921. The cleaners 934 clean the circumferential surfaces of the photosensitive drums 931 after the transfer of the toner images.

Each of the developing devices 910Y, 910M, 910C and 910K includes a housing 911, and a two-component developer including a magnetic carrier and a toner is contained in this housing 911. Further, two agitating rollers 912, 913 are rotatably arranged in the housing 911. The two agitating rollers 912, 913 extend in parallel with each other near a bottom part of the housing 911.

A circulation path for the developer is formed on the inner bottom surface of each housing 911. The agitating rollers 912, 913 are arranged in the circulation path. A partition wall 914 standing from the bottom part of the housing 911 extends in parallel with axial directions of the agitating rollers 912, 913 between the agitating rollers 912 and 913. This partition wall 914 defines the circulation path. The circulation path is formed around the partition wall 914. The two-component developer is charged while being agitated and conveyed in this circulation path by the agitating rollers 912, 913.

The two-component developer is circulated in the housing 911 while being agitated by the agitating rollers 912, 913, whereby the toner is charged and the two-component developer on the agitating roller 912 is conveyed by being attracted to a magnetic roller 915 located above. The attracted two-component developer forms a magnetic brush on the magnetic roller 915. The magnetic brush has its layer thickness restricted by a doctor blade 916. A toner layer on a developing roller 917 is formed by a potential difference between the magnetic roller 915 and the developing roller 917, and the electrostatic latent image on the photosensitive drum 931 is developed by the toner layer.

The exposure unit 94 includes a light source and various optical components such as a polygon mirror, a reflecting mirror and a deflecting mirror, and forms electrostatic latent images by radiating the circumferential surfaces of the photosensitive drums 931 respectively provided in the image forming unit 93 with beams, for example, based on image data transmitted from an external apparatus.

The intermediate transfer unit 92 includes the intermediate transfer belt 921, a drive roller 922 and a driven roller 923. Toner images are primarily transferred to the intermediate transfer belt 921 from a plurality of photosensitive drums 931 and superimposed on one another. The intermediate transfer belt 921 secondarily transfers the superimposed toner image to a sheet S supplied from the sheet feeder 4 to be described later in a secondary transfer unit 980. The drive roller 922 and the driven roller 923 drive and rotate the intermediate transfer belt 921. The drive roller 922 and the driven roller 923 are rotatably supported on the housing 2 of the printer 1.

The fixing unit 97 performs a process of fixing the toner image secondarily transferred from the intermediate transfer unit 92 to the sheet S. The sheet S with a color image finished with the fixing process is discharged toward the pair of discharge rollers 96 formed in an upper inner space of the housing 2. The pair of discharge rollers 96 discharge the sheet S conveyed from the fixing unit 97 to the recessed space 251 via the discharge opening 253 formed in the discharge wall 252 (see FIGS. 1A to 1C).

The sheet feeder 4 is for feeding a sheet S to the secondary transfer unit 980 and includes the above sheet cassette 3, a feeding mechanism 40 and the housing 2 for housing the sheet cassette 3 and the feeding mechanism 40.

The sheet cassette 3 is structured as described with reference to FIGS. 1A to 1C and includes a lift plate 381, on which a stack of sheets T made up of a plurality of sheets S is placed, in the sheet storage space 38. An upstream end portion (left end portion in FIG. 2) of the lift plate 381 is rotatably supported by supporting portions 382. In the sheet storage space 38, the lift plate 381 is rotatable upward and downward with respect to the bottom wall 35 by the supporting portions 382 with a downstream end portion (right end portion in FIG. 2) as a free end. The supporting portions 382 are provided on the right and left walls 33, 34 (see FIGS. 1A to 1C) arranged to face in a width direction of the sheets S.

Below the downstream end portion of the lift plate 381, a drive shaft 383 and a push-up member 384 are provided as an elevating mechanism for moving the lift plate 381 upward and downward. The drive shaft 383 is connected to a drive motor (not shown). When the drive motor is operated under a control by a controller responsible for the control of operations of the printer 1 in general, the drive shaft 383 rotates to lift the leading end portion of the push-up member 384 connected to the lift plate 381, whereby the downstream end portion of the lift plate 381 is lifted.

The feeding mechanism 40 feeds a sheet S from the sheet cassette 3 to the secondary transfer unit 980 when the sheet cassette 3 is completely inserted into the housing 2 and set to a predetermined position (feeding position).

Specifically, the feeding mechanism 40 is arranged between the rear wall 32 of the sheet cassette 3 inserted in the housing 2 of the printer 1 and the rear wall 22 of the housing 2 of the printer 1 and includes a pickup roller 41 arranged above the downstream end portion of the lift plate 381, a feed roller 42 arranged downstream of the pickup roller 41 and a separation roller 43 pressed in contact with the feed roller 42.

When the sheet cassette 3 is set to the feeding position, the downstream end portion of the lift plate 381 is lifted and a downstream end portion of a stack of sheets T placed on the lift plate 381 comes into contact with the pickup roller 41. When the pickup roller 41 rotates, the uppermost one S of the stack of sheets T on the lift plate 381 is picked up from the sheet cassette 3. A pickup direction of the sheet S is a direction (direction from the front wall 21 toward the rear wall 22) along an inserting direction (first direction) of the sheet cassette 3 into the housing 2 of the printer 1.

Thereafter, the sheet S picked up from the sheet cassette 3 is fed to a downstream side by the feed roller 42. When a plurality of sheets S are simultaneously picked up from the sheet cassette 3, the separation roller 43 rotates in a direction to return the lower one (s) S of the sheets picked up one over another to the sheet cassette 3. Thus, the sheets S are conveyed one by one toward the downstream side. In this way, the feeding mechanism 40 feeds the sheets S from the sheet cassette 3 to the secondary transfer unit 980.

A conveyance path extends from a downstream side of the sheet feeder 40 toward the secondary transfer unit 980 located above the feeding mechanism 40, and pairs of conveyor rollers 44 for conveying a sheet S are arranged along the conveyance path. The sheet S fed from the sheet cassette 3 by the feed roller 42 is, then, conveyed to the secondary transfer unit 980 by the pairs of conveyor rollers 44 and a toner image formed in the image forming unit 93 is transferred onto the sheet S.

Figure 3:
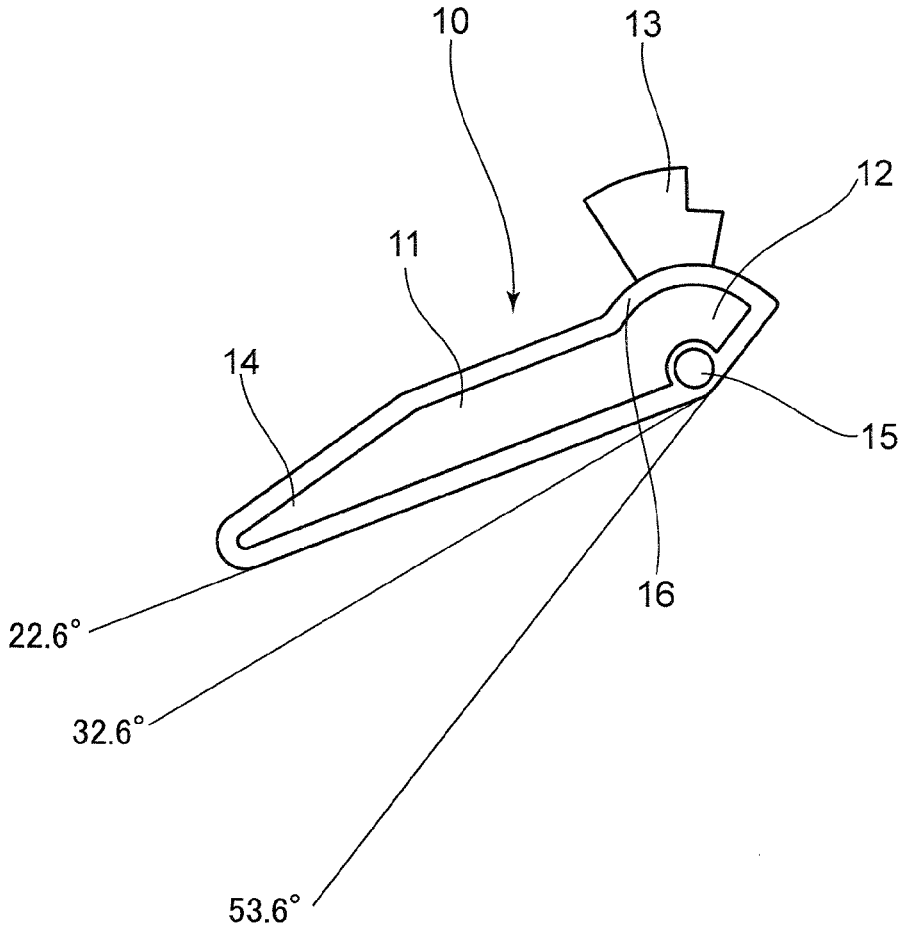
FIG. 3 is a side view of a remaining amount detecting member of a sheet feeder.
Figure 4:
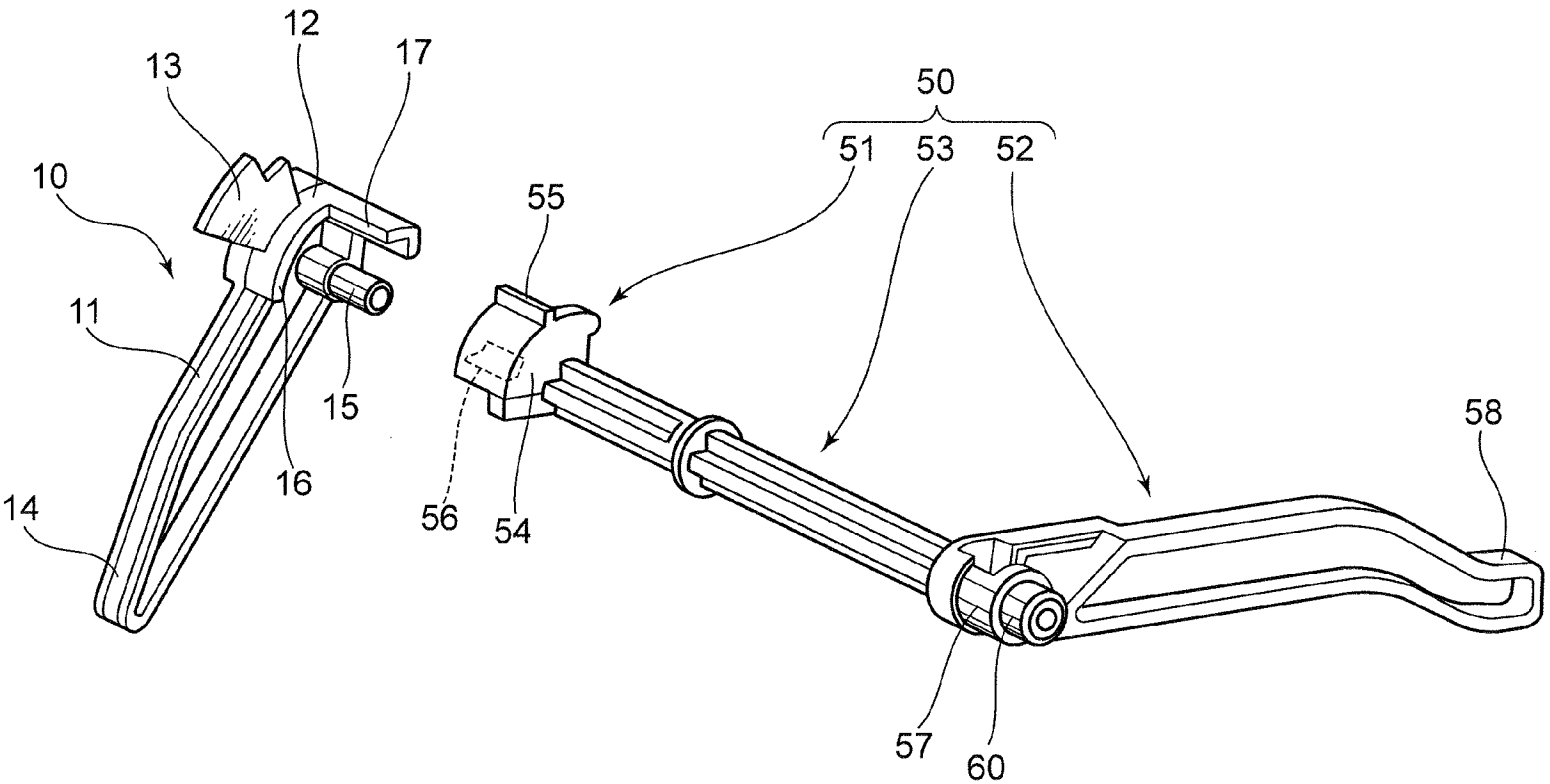
FIG. 4 is a perspective view of the remaining amount detecting member and a switching member of the sheet feeder.

The sheet feeder 4 further includes a remaining amount detecting member 10 for detecting a remaining amount of sheets S in the sheet cassette 3. The remaining amount detecting member 10 includes a contact piece 11, a rotating portion 12, a light shielding piece 13 and an unillustrated photosensor as shown in FIGS. 3 and 4.

The contact piece 11 extends in a direction opposite to the inserting direction A (FIG. 1C) of the sheet cassette 3 into the housing 2 (hereinafter, referred to as a "second direction") and includes a downstream end portion 14 located at a downstream side in the second direction. The downstream end portion 14 comes into contact with the uppermost sheet S of the stack of sheets T in the sheet cassette 3 when the sheet cassette 3 is inserted into the housing 2 and set to the feeding position.

The rotating portion 12 is integrally formed at an upstream end portion of the contact piece 11 in the second direction. The rotating portion 12 includes a rotary shaft 15 extending in a direction substantially orthogonal to the inserting direction A and the second direction and rotates the contact piece 11 upward and downward about the rotary shaft 15 in the sheet storage space 38 (FIG. 1B) of the sheet cassette 3. When the contact piece 11 rotates about the rotary shaft 15, the position of the downstream end portion 14 of the contact piece 11 changes in a vertical direction. The rotating portion 12 functions as a supporting point of rotation located at the upstream side of the contact piece 11 in the second direction.

A part of the rotating portion 12 located right above the rotary shaft 15 is formed to have an arcuate shape centered on the rotary shaft 15. The light shielding piece 13 is integrally formed to this arcuate part 16 and is a thin plate member projecting in a radial direction of the arcuate part 16 and extending a predetermined distance in a circumferential direction of the arcuate part 16. Thus, when the rotating portion 12 rotates about the rotary shaft 15, i.e. when the contact piece 11 rotates upward or downward about the rotary shaft 15, the light shielding piece 13 rotates together.

The light shielding piece 13 is located between a light emitting element and a light receiving element of the unillustrated photosensor and shields light emitted from the light emitting element. An amount of light shielded by the light shielding piece 13 is determined by a rotation amount of the contact piece 11 in the vertical direction. Since the contact piece 11 rotates upward and downward according to the remaining amount of the sheets S in the sheet cassette 3, the remaining amount of the sheets S in the sheet cassette 3 can be detected by detecting the light shielding amount by the light shielding piece 13 that rotates according to the rotation of the contact piece 11.

The remaining amount of the sheets S is judged to be sufficient based on a light shielding amount by the light shielding piece 13 obtained when an angle between the contact piece 11 and the uppermost sheet S reaches, for example, 22.6° by the rotation of the contact piece 11. Further, the remaining amount of the sheet S is judged to be little based on a light shielding amount obtained when the above angle reaches 32.6°, and it is judged to be empty based on a light shielding amount obtained when the above angle reaches 53.6°.

In this embodiment, the sheet feeder 4 can switch the position of the contact piece 11 of the remaining amount detecting member 10 between a contact position where the contact piece 11 enters the sheet storage space 38 of the sheet cassette 3 to come into contact with the uppermost sheet S and a retracted position where the contact piece 11 is retracted from the sheet storage space 38 of the sheet cassette 3. A switching member 50 shown in FIG. 4 is used as a member for this purpose.

The switching member 50 switches the position of the contact piece 11 to the contact position when the sheet cassette 3 is inserted into the housing 2 in the inserting direction A and set to the feeding position while switching the position of the contact piece 11 to the retracted position when the sheet cassette 3 is separated from the feeding position and withdrawn from the housing 2. The contact position and the retracted position of the contact piece 11 are described later.

As shown in FIG. 4, the switching member 50 includes a pressing portion 51, a touching piece 52, and a coupling piece 53 coupling the pressing portion 51 and the touching piece 52.

The pressing portion 51 is formed to be able to rotate the contact piece 11 by pressing the rotating portion 12 of the remaining amount detecting member 10 and includes a receiving portion 54 and a pressing projection 55.

The receiving portion 54 is shaped to be able to rotatably receive the rotary shaft 15 of the rotating portion 12 and includes a groove portion 56 into which the rotary shaft 15 is rotatably fitted. Note that an insertion hole, into which the rotary shaft 15 is rotatably inserted, may be formed instead of the groove portion 56.

Figure 5:
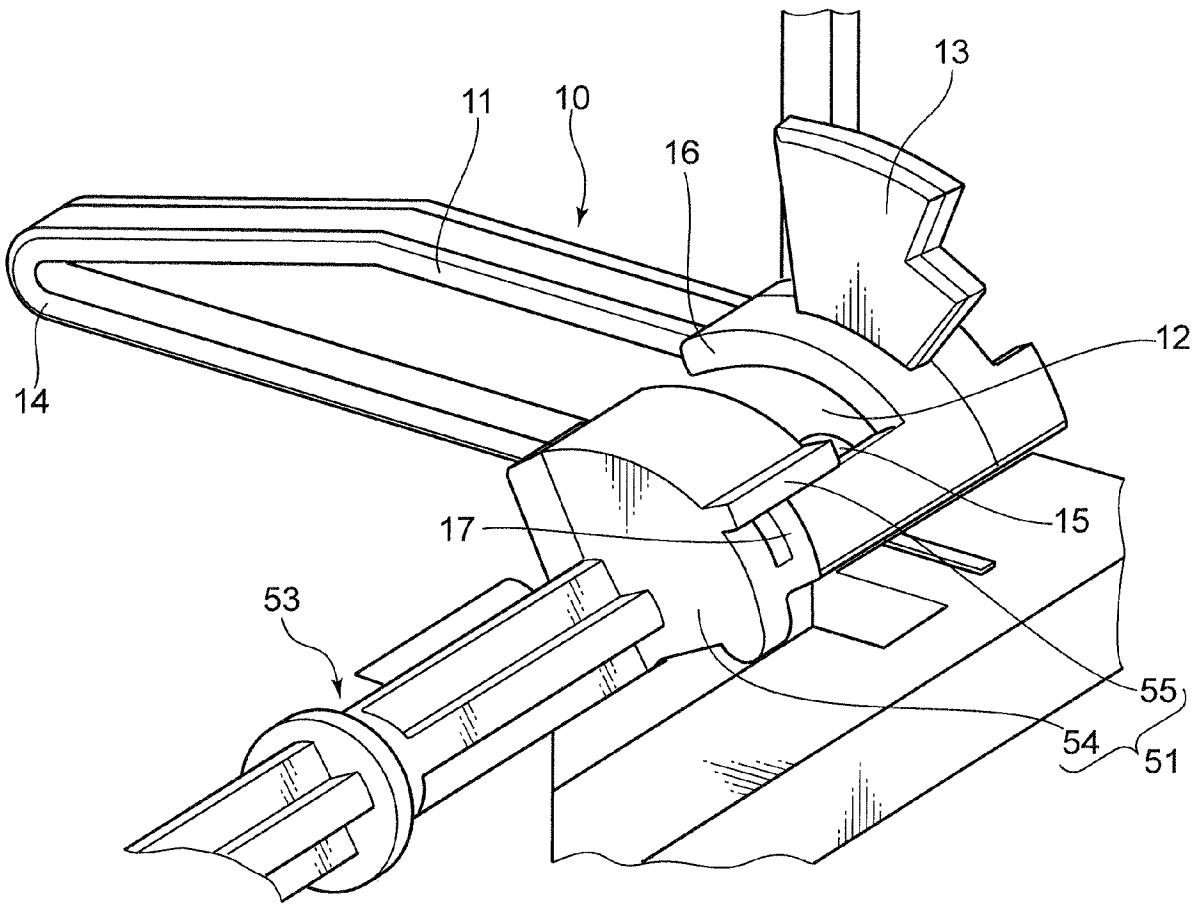
FIG. 5 is an enlarged perspective view of the remaining amount detecting member and the switching member showing a state where a pressing portion is in contact with a rotating portion.

The pressing projection 55 is so integrally formed to the receiving portion 54 at a position above the groove portion 56 as to extend along an axial direction of the rotary shaft 15 with the rotary shaft 15 fitted in the groove portion 56. In addition to the rotary shaft 15, an extending piece 17 extending near the rotary shaft 15 is integrally formed to the rotating portion 12. The extending piece 17 is located radially outwardly of the rotary shaft 15 and set to extend along the axial direction of the rotary shaft 15 in FIG. 4. With the rotary shaft 15 fitted in the groove portion 56, the pressing projection 55 can be in contact with the extending piece 17 and press the extending piece 17 as shown in FIG. 5.

The touching piece 52 has a lever shape extending in a direction substantially orthogonal to the rotary shaft 15 and includes a first end portion 57 and a second end portion 58 located at the opposite ends in this orthogonal direction. The coupling piece 53 coupling the pressing portion 51 and the touching piece 52 is in the form of a bar extending along the axial direction of the rotary shaft 15, one end thereof is integrally fixed to the receiving portion 54 of the pressing portion 51 and the other end thereof is integrally fixed to the first end portion 57 of the touching piece 52. The second end portion 58 of the touching piece 52 is a free end. An angle between the touching piece 52 and the coupling piece 53 is set to be a substantially right angle.

A shaft portion 60 projecting along the axial direction of the rotary shaft 15 is integrally formed to the first end portion 57 of the touching piece 52. The shaft portion 60 is rotatably received by a groove or hole formed in an unillustrated supporting body for supporting the switching member 50. Accordingly, the touching piece 52 is rotatable upward and downward about the shaft portion 60. The pressing portion 51 coupled to the touching piece 52 via the coupling piece 53 rotates as the touching piece 52 rotates.

Figure 6:
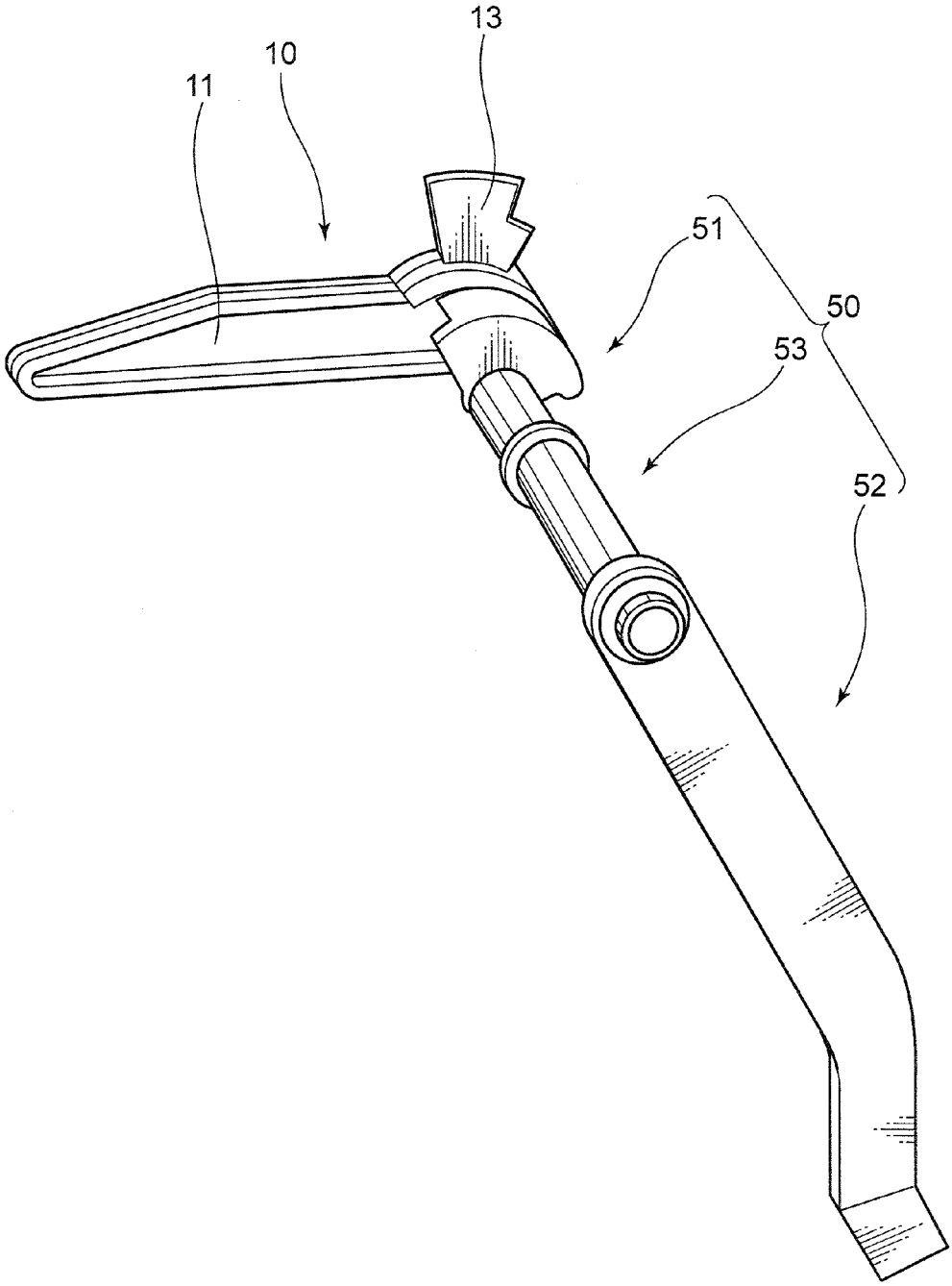
FIG. 6 is a perspective view of the remaining amount detecting member and the switching member showing a state where the pressing portion presses the rotating portion to rotate a contact piece upward.

Specifically, when the touching piece 52 rotates downward, the pressing portion 51 rotates clockwise. Simultaneously, the pressing projection 55 comes into contact with the extending piece 17 of the rotating portion 12 as shown in FIG. 5 to press the extending piece 17 clockwise under the action of the weight of the touching piece 52. Since the rotary shaft 15 of the rotating portion 12 is rotatably fitted into the groove portion 56 of the receiving portion 54 of the pressing portion 51, the contact piece 11 rotates upward as the extending piece 17 receives a pressing force from the pressing projection 55. FIG. 6 shows a state where the contact piece 11 is rotated upward by the downward rotation of the touching piece 52. Unless the sheet cassette 3 is inserted into the housing 2 and set to the feeding position, the contact piece 11 is held at the position shown in FIG. 6, i.e. at the retracted position due to the weight of the touching piece 52. Since the touching piece 52 rotates downward due to its own weight, there is no need for a mechanical mechanism for rotating the touching piece 52 downward.

Further, the length of the touching piece 52 is so set that the touching piece 52 can come into contact with the rear wall 32 (FIG. 1B) of the sheet cassette 3 in a direction opposite to the inserting direction A when the sheet cassette 3 is inserted in the housing 2. The rear wall 32 constitutes a downstream wall portion of the sheet cassette 3 in the inserting direction A.

Next, how the position of the contact piece 11 is switched by the switching member 50 is described with reference to FIGS. 7 to 10. The pickup roller 41 and the feed roller 42 are not shown to simplify graphical representation in FIGS. 7 and 10 as well as FIG. 6.

Figure 7:
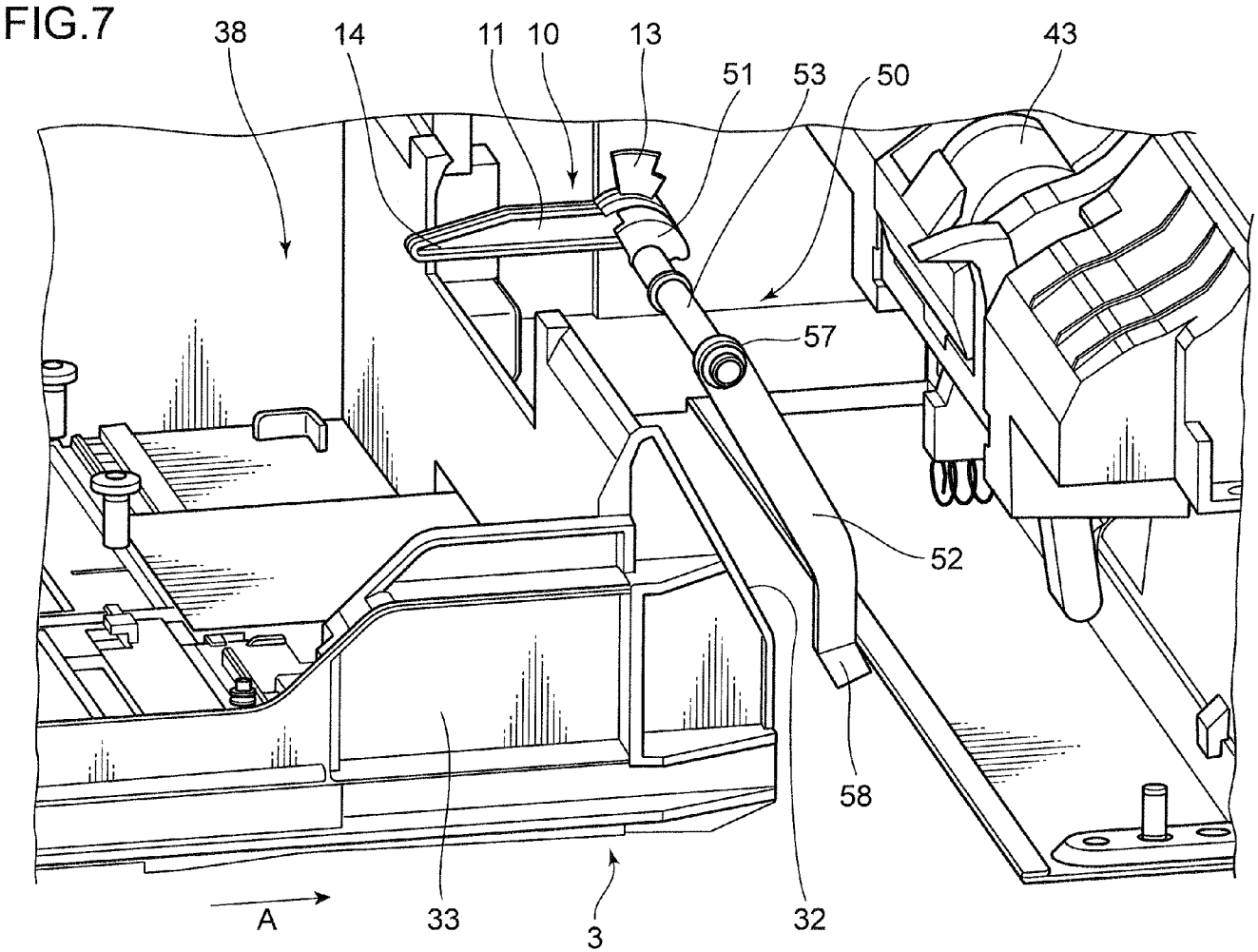
FIG. 7 is a perspective view of the remaining amount detecting member and the switching member showing a state where the contact piece is at a retracted position.

When the sheet cassette 3 is inserted into the housing 2 and advances toward the feeding position as shown in FIG. 7, the touching piece 52 of the switching member 50 comes into contact with the rear wall 32 of the sheet cassette 3 in the direction opposite to the inserting direction A. When the sheet cassette 3 is further moved toward the feeding position after the touching piece 52 comes into contact with the rear wall 32, the touching piece 52 starts rotating upward by a pressing force received from the rear wall 32.

Figure 8:
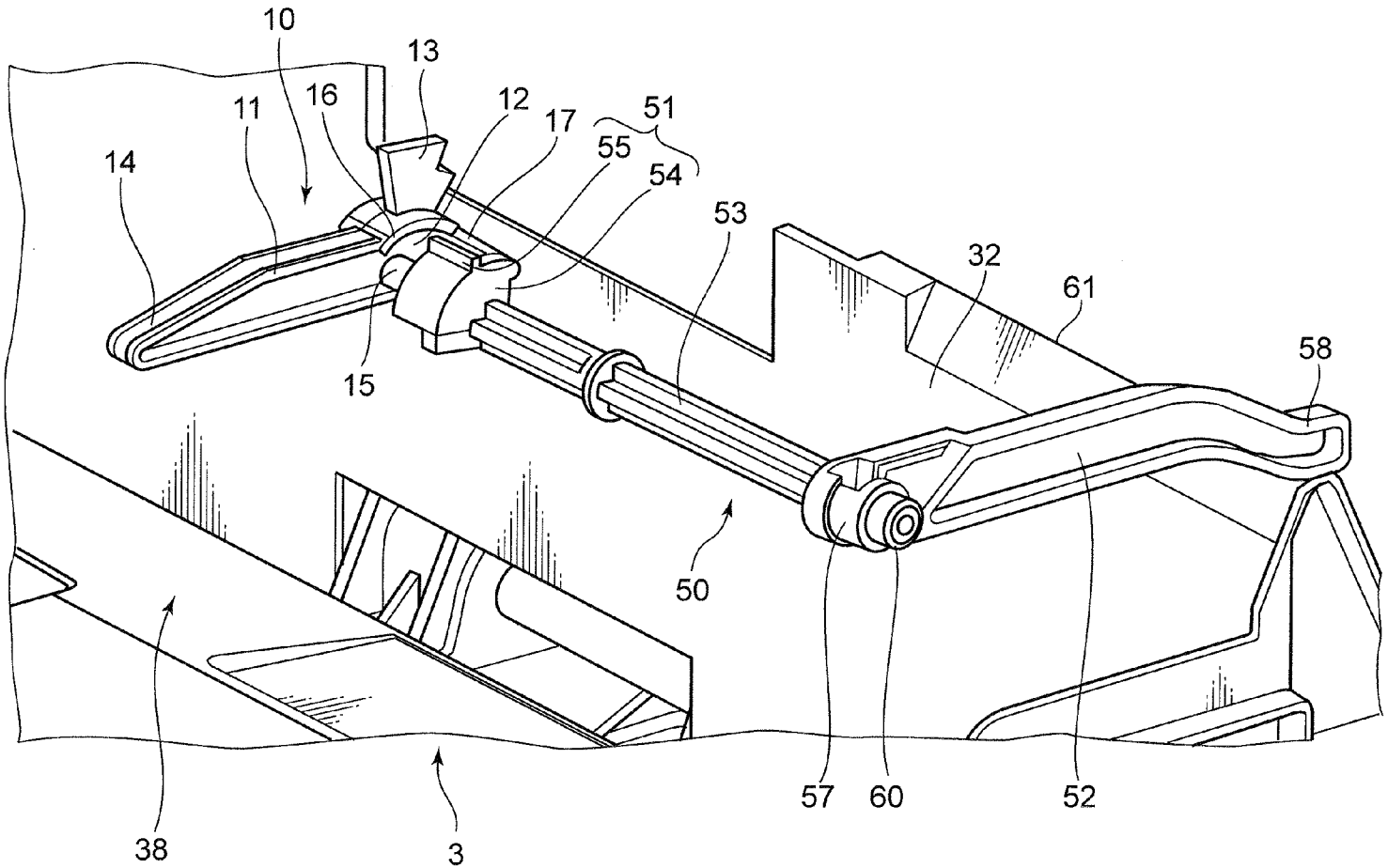
FIG. 8 is an enlarged perspective view of the remaining amount detecting member and the switching member showing a state where the contact piece is at a contact position.

When the sheet cassette 3 is set to the feeding position, the touching piece 52 is located above the sheet storage space 38 with the second end portion 58 placed on an upper edge 61 of the rear wall 32 as shown in FIG. 8. The pressing portion 51 and the coupling piece 53 of the switching member 50 are also located above the sheet storage space 38.

Figure 9:
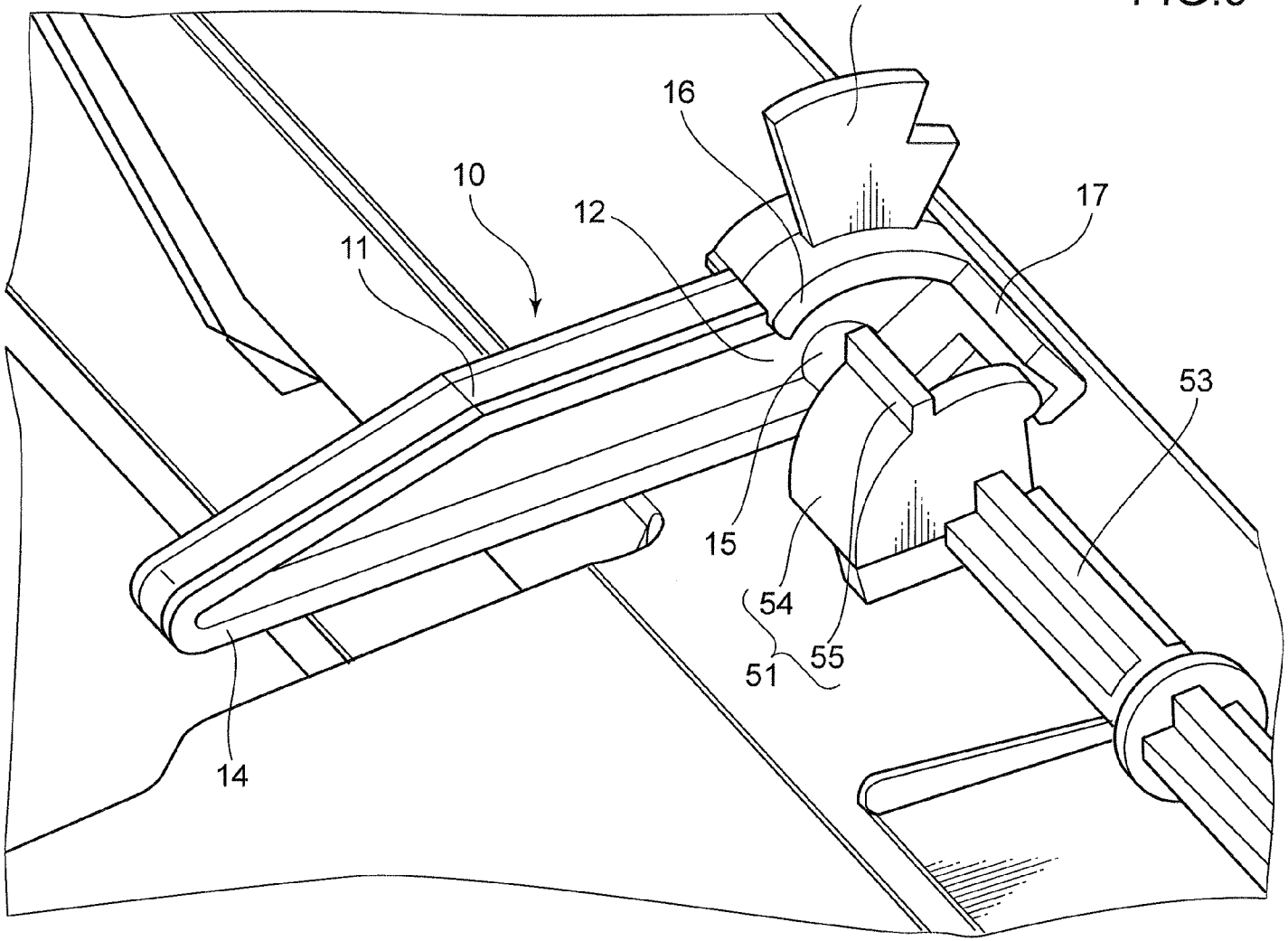
FIG. 9 is a partial enlarged view of FIG. 8 showing a state where the pressing portion is separated from the rotating portion.

As the touching piece 52 is rotated upward by the rear wall 32, i.e. as the touching piece 52 is supported more from below by the rear wall 32, the pressing force given from the pressing projection 55 of the pressing portion 51 to the extending piece 17 of the rotating portion 12 decreases. Thus, the contact piece 11 starts rotating downward due to the weight thereof as the touching piece 52 rotates upward. Then, when the sheet cassette 3 is set to the feeding position and the second end portion 58 of the touching piece 52 moves onto the upper edge 61 of the rear wall 32, the pressing projection 55 is separated from the extending piece 17 as shown in FIG. 9. In other words, the pressing projection 55 is so restricted as not to press the extending piece 17. Accordingly, the contact piece 11 rotates downward to enter the sheet storage space 38 of the sheet cassette 3 from above, whereby the downstream end portion 14 thereof comes into contact with a surface of the uppermost sheet S. Thus, the contact piece 11 is switched from the retracted position to the contact position. FIGS. 8 and 9 show a state where the contact piece 11 is in contact with the uppermost sheet when the sheet storage space 38 is fully filled with sheets. In FIGS. 8 and 9, the sheets S are not shown.

Since the contact piece 11 can rotate downward due to the weight thereof after being switched to the contact position, there is no need for a mechanical mechanism for rotating the contact piece 11 downward.

Figure 10:
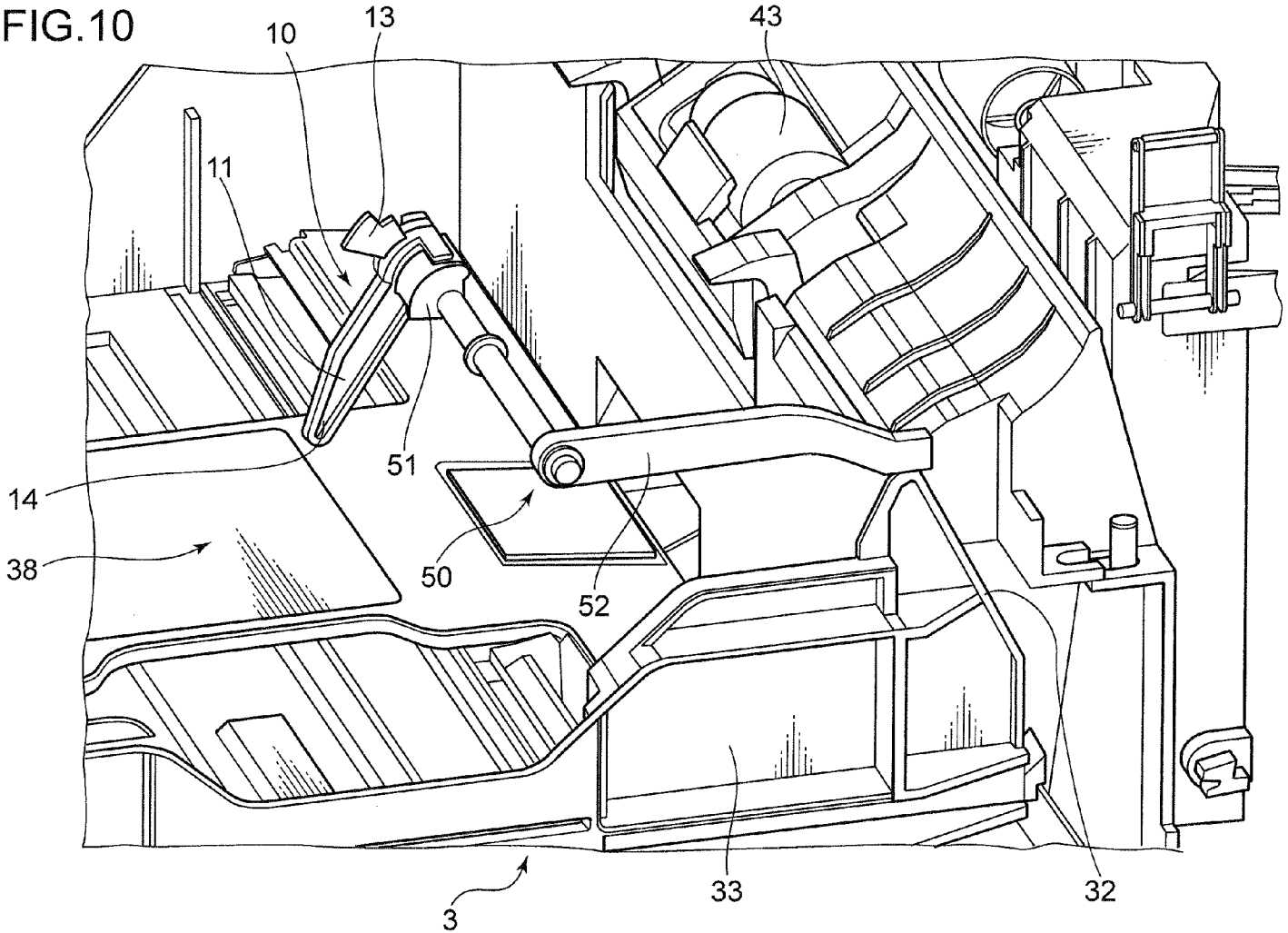
FIG. 10 is a perspective view of the sheet cassette, the remaining amount detecting member and the switching member showing a state of the contact piece rotated according to a reduction in the number of sheets.

As described above, when the sheets S are picked up one by one from the sheet storage space 38 by the feeding mechanism and fed to the secondary transfer unit 980 with the sheet cassette 3 set to the feeding position and the contact piece 11 switched to the contact position, the contact piece 11 rotates downward due to the weight thereof as shown in FIG. 10 as the sheets S decrease in number. The remaining amount of the sheets S is detected based on the rotation amount of the contact piece 11 as described above.

When sheet replenishment is judged to be necessary based on the detection of the remaining amount detecting member 10, the sheet cassette 3 is withdrawn to the outside from the housing 2 by a user in a state shown in FIG. 10. When it is started to withdraw the sheet cassette 3, the touching piece 52 starts rotating downward due to the weight thereof. Simultaneously, the pressing projection 55 comes into contact with the extending piece 17 and starts pressing the extending piece 17 as shown in FIG. 5. When the touching piece 52 is separated from the rear wall 32 of the sheet cassette 3, the contact piece 11 rotates further upward due to the weight of the touching piece 52 to be retracted from the sheet storage space 38. In this way, the contact piece 11 is switched to the retracted position as shown in FIG. 7.

According to the sheet feeder 4 described above, when the sheet cassette 3 is separated from the feeding position and withdrawn from the housing 2, the position of the contact piece 11 is switched to the retracted position where the contact piece 11 is retracted out from the sheet storage space 38. Thus, even if the contact piece 11 extends in the second direction opposite to the inserting direction A (first direction) and the downstream end portion 14 comes into contact with the uppermost sheet S at the downstream side in the second direction, the contact piece 11 is not caught by the uppermost sheet S in the sheet cassette 3 when the sheet cassette 3 having a new stack of sheets T placed therein is inserted into the housing 2 again. The contact piece 11 is switched to the contact position and comes into contact with the uppermost sheet S when the sheet cassette 3 is set to the feeding position in the housing 2. This can prevent the contact piece 11 from being damaged during the insertion of the sheet cassette 3 into the housing 2.

Since the position of the contact piece 11 is switched by a simple construction for pressing the extending piece 17 of the rotating portion 12 by the pressing projection 55 of the pressing portion 51, the structure of the sheet feeder 4 is not complicated. The shapes of the extending piece 17 and the pressing projection 55 are not particularly limited provided that the pressing portion 51 can rotate the rotating portion 12.

In the sheet feeder 4 of this embodiment, the touching piece 52 comes into contact with the rear wall 32 of the sheet cassette 3 to separate the pressing projection 55 from the extending piece 17 when the sheet cassette 3 is inserted into the housing 2, whereas the sheet cassette 3 is separated from the rear wall 32 to permit the pressing projection 55 to press the extending piece 17 when being withdrawn from the housing 2. Thus, the position switch of the contact piece 11 can be synchronized with the insertion and withdrawal of the sheet cassette 3.

Specific constructions of the rotating portion 12, the pressing portion 51 and the touching piece 52 are preferably as follows. Specifically, the rotating portion 12 includes the rotary shaft 15 and the extending piece 17 extending near the rotary shaft 15. The pressing portion 51 includes the receiving portion 54 shaped to be able to rotatably receive the rotary shaft 15 and the pressing projection 55 formed in the receiving portion 54 and shaped to be able to come into contact with the extending piece 17. The touching piece 52 is a member coupled to the receiving portion 54 and rotatable upward and downward. The touching piece 52 rotates downward to rotate the receiving portion 54, thereby bringing the pressing projection 55 into contact with the extending piece 17 to press the extending piece 17, when the sheet cassette 3 is withdrawn from the housing 2, whereas the touching piece 52 rotates upward to rotate the receiving portion 54, thereby separating the pressing projection 55 from the extending piece 17, when the sheet cassette 3 is inserted into the housing 2.

This application is based on Japanese Patent application No. 2010-072152 filed in Japan Patent Office on Mar. 26, 2010, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A sheet feeder, comprising:

a housing;

a sheet cassette having a wall portion that defines a storage space for storing sheets and insertable into the housing in a first direction;

a feed roller feeding the sheets from the sheet cassette when the sheet cassette is set to a feeding position;

a remaining amount detecting member including a rotatable contact piece and a rotating portion rotating the contact piece upward and downward with respect to the storage space, and detecting a remaining amount of the sheets in the sheet cassette according to a position of the contact piece, the contact piece extending in a second direction opposite to the first direction, including a supporting point at an upstream side in the second direction and coming into contact with an uppermost one of the sheets in the sheet cassette at a downstream side, the rotating portion including a rotary shaft and an extending piece extending near the rotary shaft; and a switching member switching the position of the contact piece between a contact position where the contact piece enters the storage space to come into contact with the uppermost sheet and a retracted position where the contact piece is retracted from the storage space, the switching member including a pressing portion capable of pressing the rotating portion and a touching piece capable of coming into contact with the wall portion of the sheet cassette, the pressing portion including a receiving portion having a shape capable of rotatably receiving the rotary shaft and a pressing projection formed on the receiving portion and having a shape capable of coming into contact with the extending piece, the touching piece being connected to the receiving portion and configured to rotate upward and downward;

wherein the touching piece of the switching member comes into contact with the wall portion and is rotated upward when the sheet cassette is inserted into the housing in the first direction and set to the feeding position, thereby rotating the receiving portion, separating the pressing projection from the extending piece and permitting the contact piece to rotate downward to the contact position, while the touching piece separates from the wall portion and rotates downward when the sheet cassette is separated from the feeding position and withdrawn from the housing, thereby rotating the receiving portion, bringing the pressing projection into contact with the extending piece and rotating the contact piece upward to the retracted position.

2. A sheet feeder according to claim 1, wherein:

the wall portion of the sheet cassette includes a downstream wall portion that is located at a downstream side in the first direction;

the touching piece is capable of coming into contact with the downstream wall portion in a direction opposite to the first direction; and the touching piece comes into contact with the downstream wall portion when the sheet cassette is inserted into the housing while being separated from the downstream wall portion when the sheet cassette is withdrawn from the housing.

3. A sheet feeder according to claim 1, wherein the touching piece rotates downward due to the weight thereof.

4. A sheet feeder according to claim 1, wherein the contact piece rotates downward due to the weight thereof.

5. An image forming apparatus, comprising:

an image forming unit forming images on sheets;

a sheet feeder feeding the sheets to the image forming unit, the sheet feeder including:

a housing;

a sheet cassette having a storage space for storing sheets and insertable into the housing in a first direction;

a feed roller feeding the sheets from the sheet cassette when the sheet cassette is set to a feeding position;

a remaining amount detecting member including a rotatable contact piece and a rotating portion rotating the contact piece upward and downward with respect to the storage space, and detecting a remaining amount of the sheets in the sheet cassette according to a position of the contact piece, the contact piece extending in a second direction opposite to the first direction, including a supporting point at an upstream side in the second direction and coming into contact with an uppermost one of the sheets in the sheet cassette at a downstream side, the rotating portion including a rotary shaft and an extending piece extending near the rotary shaft; and a switching member switching the position of the contact piece between a contact position where the contact piece enters the storage space to come into contact with the uppermost sheet and a retracted position where the contact piece is retracted from the storage space, the switching member including a pressing portion capable of pressing the rotating portion and a touching piece capable of coming into contact with the wall portion of the sheet cassette, the pressing portion including a receiving portion having a shape capable of rotatably receiving the rotary shaft and a pressing projection formed in the receiving portion and having a shape capable of coming into contact with the extending piece, the touching piece being connected to the receiving portion and configured to rotate upward and downward;

wherein the touching piece of the switching member comes into contact with the wall portion and is rotated upward when the sheet cassette is inserted into the housing in the first direction and set to the feeding position, thereby rotating the receiving portion, separating the pressing projection from the extending piece and permitting the contact piece to rotate downward to the contact position, while the touching piece separates from the wall portion and rotates downward when the sheet cassette is separated from the feeding position and withdrawn from the housing, thereby rotating the receiving portion, bringing the pressing projection into contact with the extending piece and rotating the contact piece upward to the retracted position.

6. An image forming apparatus according to claim 5, wherein:

the wall portion of the sheet cassette includes a downstream wall portion that is located at a downstream side in the first direction;

the touching piece is capable of coming into contact with the downstream wall portion in a direction opposite to the first direction; and the touching piece comes into contact with the downstream wall portion when the sheet cassette is inserted into the housing while being separated from the downstream wall portion when the sheet cassette is withdrawn from the housing.

7. An image forming apparatus according to claim 5, wherein the touching piece rotates downward due to the weight thereof.

8. An image forming apparatus according to claim 5, wherein the contact piece rotates downward due to the weight thereof.

* * * * *